US007527367B2

(12) United States Patent
Morita

(10) Patent No.: US 7,527,367 B2
(45) Date of Patent: May 5, 2009

(54) INK PACKAGE

(75) Inventor: Yoshitsugu Morita, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 262 days.

(21) Appl. No.: 10/816,966

(22) Filed: Apr. 2, 2004

(65) Prior Publication Data

US 2004/0201654 A1 Oct. 14, 2004

(30) Foreign Application Priority Data

Apr. 9, 2003 (JP) ..... 2003-105163

(51) Int. Cl.
*B41J 2/175* (2006.01)

(52) U.S. Cl. ..... 347/86; 347/85

(58) Field of Classification Search ..... 347/85, 347/86

See application file for complete search history.

(56) References Cited

U.S. PATENT DOCUMENTS

| | | | | |
|---|---|---|---|---|
| 3,730,240 | A | 5/1973 | Presnick | |
| 4,558,326 | A | 12/1985 | Kimura et al. | |
| 6,030,074 | A | 2/2000 | Barinaga | |
| 6,036,296 | A * | 3/2000 | Axtell et al. | 347/86 |
| 6,074,042 | A | 6/2000 | Gasvoda et al. | |
| 6,074,050 | A * | 6/2000 | Perez et al. | 347/86 |
| 6,116,723 | A * | 9/2000 | Childers | 347/85 |
| 6,158,853 | A * | 12/2000 | Olsen et al. | 347/86 |
| 6,243,115 | B1 * | 6/2001 | Baker et al. | 347/85 |
| 6,250,748 | B1 | 6/2001 | Sasaki et al. | |
| 6,435,638 | B1 * | 8/2002 | Wilson et al. | 347/7 |
| 6,508,545 | B2 * | 1/2003 | Dowell et al. | 347/85 |
| 6,715,864 | B2 * | 4/2004 | Perkins et al. | 347/86 |
| 6,746,111 | B2 * | 6/2004 | Thielman et al. | 347/86 |
| 6,874,878 | B2 * | 4/2005 | Sugata | 347/86 |

FOREIGN PATENT DOCUMENTS

| | | |
|---|---|---|
| EP | 0 581 081 A2 | 9/1993 |
| EP | 0941854 A2 * | 10/1998 |
| EP | 0 890 441 A2 | 1/1999 |
| JP | A-59-59457 | 4/1984 |
| JP | B2-3-61592 | 8/1984 |
| JP | 62-134736 | 6/1987 |
| JP | 09-327930 | 12/1997 |
| JP | A-11-129489 | 5/1999 |
| JP | 11300984 | 11/1999 |
| JP | 2001 212973 | 8/2001 |
| JP | 2001232812 | 8/2001 |
| JP | 2002-513341 | 5/2002 |
| JP | 2002-172799 | 6/2002 |

* cited by examiner

*Primary Examiner*—Matthew Luu
*Assistant Examiner*—Shelby Fidler
(74) *Attorney, Agent, or Firm*—Reed Smith LLP

(57) ABSTRACT

An ink package including: an ink accommodating bag in which ink is accommodated and which is formed of a first flexible sheet; an outer bag which is formed of a second flexible sheet and which encloses the ink accommodating bag such that a space is defined by and between the ink accommodating bag and the outer bag; and an ink delivering member including a fixing portion to which the outer bag is fixed at an opening thereof and an extending portion which is formed adjacent to the fixing portion so as to extend toward an inside of the outer bag in a first direction of the fixing portion and to which the ink accommodating bag is fixed at an opening thereof; and wherein the ink delivering member further includes an ink outlet passage through which the ink in the ink accommodating bag is delivered to an exterior of the ink package and a communication passage through which the space is held in communication with the exterior of the ink package.

21 Claims, 9 Drawing Sheets

INK PACKAGE

The present application is based on Japanese Patent Application No. 2003-105163 filed Apr. 9, 2003, the contents of which are incorporated herein by reference.

BACKGROUND OF THE INVENTION

1. Field of the Invention

The present invention relates in general to an ink package having a simple structure which prevents deterioration of a degree of deaeration of ink accommodated in the ink package and evaporation of an aqueous component of the ink, the ink in the ink package being given positive pressure in the simple structure. The present invention also relates to a method of producing such an ink package.

2. Discussion of Related Art

As disclosed in JP-A-11-129489 (FIG. 1, in particular), there is known an ink bag in which ink is fluid-tightly accommodated and which is used for an ink-jet recording apparatus. To the opening of the ink bag, there is fixed a tubular member into which an elastic sealing member is fitted for inhibiting communication between an exterior and an interior of the ink bag. The ink bag is accommodated in and attached to a cartridge casing such that one of opposite ends of the tubular member is exposed to an exterior of the casing. The cartridge casing in which the ink bag is accommodated is installed on the ink-jet recording apparatus. Upon installation of the cartridge casing on the recording apparatus, an ink-extracting needle of the apparatus pierces the elastic sealing member fitted in the tubular member, so that the ink in the ink bag is supplied, via a tube connected to the ink-extracting needle, to the ink-jet printing head through which the ink is ejected to a recording medium.

The ink used for the ink-jet recording apparatus is manufactured by a process including a step of dissolving an ink material in a solvent, and a step of filtering a solution of the ink material. Where the ink as manufactured by this process is accommodated in the ink bag for use on the ink-jet recording apparatus, various kinds of gases such as nitrogen, oxygen and carbon dioxide that are dissolved in the ink are introduced together with the ink into the ink-jet printing head, causing bubbles that may prevent the ink-jet printing head from smoothly ejecting droplets of the ink, giving rise to a risk of a poor ink-ejecting performance of the head. To avoid this drawback, it has been practiced to carry out a deaerating or degassing treatment of the ink, so as to reduce the amounts of the dissolved gases before the ink is accommodated in the ink bag.

When the ink bag in which the thus deaerated or degassed ink is accommodated is transported, or stored for a long time before its use, oxygen and other gases in the air may be dissolved in the ink. JP-B2-3-61592 (column 4, lines 4-7, and FIG. 1, in particular) discloses a technique to prevent the dissolution of such gases in the ink. According to this technique, an ink bag filled with the degassed ink is accommodated in a suitable ink-bag casing, and this ink-bag casing is placed in a vacuum chamber the pressure of which is adjusted to a reduced pressure lower than the atmospheric level, and is fluid-tightly enclosed or accommodated within a sealing wrapper or container such as a plastic or rubber bag or a metallic can or box, so that the casing is kept under the reduced pressure in the evacuated container, during transportation or storage.

JP-A-59-59457 or its corresponding U.S. Pat. No. 4,558,326 discloses a technique of conducting a so-called "purging operation" for discharging or getting rid of, from the ink-jet printing head, bubbles and poor-quality ink whose viscosity has been increased. In the disclosed technique, there is supplied positively pressurized air between an ink bag in which the ink is accommodated and a rigid cartridge casing in which the ink bag is accommodated, so that the ink in the ink bag is pressurized. The pressurized ink is supplied to the ink-jet printing head.

Where the ink bag filled with the deaerated ink is accommodated in the ink-bag casing as disclosed in JP-B-3-61592, the ink-bag casing enclosed in the evacuated container is kept in a substantially fluid-tightly or hermetically sealed state, so that a space between the ink-bag casing and the container is easily kept exposed to the reduced pressure lower than the atmospheric pressure. However, it is rather difficult to evacuate a space between the ink bag and the ink-bag casing to the reduced pressure. Accordingly, the air existing in the space between the ink bag and the ink-bag casing is inevitably dissolved in the ink in the ink bag, undesirably deteriorating the deaeration degree of the ink.

For satisfying a recent demand for increasing the volume of the ink to be accommodated in the ink bag, it is necessary to increase the size of the cartridge casing in which the ink bag is accommodated. Since the ink bag generally has a flattened shape as disclosed in JP-A-11-129489, the rigid cartridge casing for accommodating the ink bag also has a flattened shape having walls of a large surface area. If the cartridge casing accommodated in the container is exposed to the reduced pressure, the cartridge casing having the flattened shape is undesirably deformed at the walls of the large surface area due to the exposure to the reduced pressure. To avoid this, the cartridge casing needs to be manufactured such that the cartridge casing exhibits a relatively high degree of mechanical strength. However, this undesirably pushes up the cost of the manufacture of the cartridge casing.

Where the positively pressurized air is supplied between the ink bag and the rigid cartridge casing as disclosed in JP-A-59-59457, it is required to fluid-tightly seal, with high stability, connecting portions of components of the rigid cartridge casing to prevent a leakage flow of the positively pressurized air therefrom for supplying, to the ink-jet printing head, the ink under predetermined pressure. Accordingly, the cost of manufacture of the cartridge casing is inevitably increased.

SUMMARY OF THE INVENTION

It is therefore a first object of the present invention to provide an ink package having a simple structure which prevents deterioration of the deaeration degree of the ink accommodated in the ink package and evaporation of the aqueous component of the ink, the ink in the ink package being given positive pressure in the simple structure.

It is a second object of the present invention to provide a method of producing the ink package of the invention.

It is a third object of the present invention to provide an ink-jet recording apparatus which includes the ink package of the invention.

The first object indicated above may be achieved according to a first aspect of the present invention, which provides an ink package comprising: an ink accommodating bag in which ink is accommodated and which is formed of a first flexible sheet; an outer bag which is formed of a second flexible sheet and which encloses the ink accommodating bag such that a space is defined by and between the ink accommodating bag and the outer bag; and an ink delivering member including a fixing portion to which the outer bag is fixed at an opening thereof and an extending portion which is formed adjacent to the fixing portion so as to extend toward an inside of the outer bag in a first direction of the fixing portion and to which the ink accommodating bag is fixed at an opening thereof; and wherein the ink delivering member further includes an ink outlet passage through which the ink in the ink accommodating bag is delivered to an exterior of the ink package and a communication passage through which the space is held in communication with the exterior of the ink package.

In the ink package constructed according to the above-described first aspect of the present invention wherein the ink is enclosed with the two bags, i.e. the ink accommodating bag and the outer bag in which the ink accommodating bag is accommodated, the outside air is less likely to permeate through the two bags, so that the ink accommodated in the ink accommodating bag is effectively prevented from being brought into contact with or exposed to the outside air. Accordingly, it is possible, in a relatively simple structure, to prevent deterioration of the deaeration degree of the ink and evaporation of the aqueous component of the ink. In the present ink package constructed as described above, at least one of evacuation of the space to the reduced pressure carried out upon manufacture of the ink package and the application of the positively pressurized air to the space carried out upon its use can be easily conducted through the communication passage.

In a first preferred form of the above-described first aspect of the invention, the communication passage is in the form of a labyrinth having at least one bent portion.

In the ink package constructed according to the first preferred form described above, the distance between the exterior of the ink package and the space defined by and between the two bags, in other words, the length of the communication passage is made long, it is effective to keep gases and vapors within the space, so that the atmosphere in the space can be maintained in a desirable state. Therefore, this arrangement is effective to prevent deterioration of the deaeration degree of the ink and evaporation of the aqueous component of the ink.

In a second preferred form of the above-described first aspect of the invention, the space is in a state, upon shipment of the ink package, in which the space is evacuated to a reduced pressure, the ink package further comprising a sealing member which is removably provided so as to close the communication passage.

In the ink package constructed according to the second preferred form described above, the dissolution of the gases in the ink in the ink accommodating bag and the evaporation of the aqueous component of the ink can be effectively prevented during transportation of the ink package and storage of the ink package for a relatively long period. Accordingly, this arrangement is effective to prevent the deterioration of the deaeration degree of the ink and the evaporation of the aqueous component of the ink.

In a third preferred form of the above-described first aspect of the invention, each of the first and second flexible sheets is provided by a material which substantially inhibits gases or vapors from permeating therethrough.

In the ink package constructed according to the third preferred form described above, the deterioration of the deaeration degree of the ink and the evaporation of the aqueous component of the ink can be prevented with improved reliability.

The first object indicated above may also be achieved according to a second aspect of the invention, which provides an ink package comprising: an ink accommodating bag in which ink is accommodated and which is formed of a first flexible sheet; an outer bag which is formed of a second flexible sheet and which encloses the ink accommodating bag such that a space is defined by and between the ink accommodating bag and the outer bag and; an ink delivering member including a fixing portion to which the outer bag is fixed at an opening thereof and an extending portion which is formed adjacent to the fixing portion so as to extend therefrom toward an inside of the outer bag and to which the ink accommodating bag is fixed at an opening thereof, and wherein the ink delivering member further includes an ink outlet passage through which the ink in the ink accommodating bag is delivered to an exterior of the ink package, and the space which is defined by and between the ink accommodating bag and the outer bag is in a state, upon shipment of the ink package, in which the space is evacuated to a reduced pressure.

In the ink package constructed according to the above-described second aspect of the invention, the outside air is less likely to permeate through the two bags, so that the ink accommodated in the ink accommodating bag is effectively prevented from being brought into contact with or exposed to the outside air. Further, the dissolution of the gases in the ink in the ink accommodating bag and the evaporation of the aqueous component of the ink can be effectively prevented during transportation of the ink package and storage of the ink package for a relatively long period. Accordingly, this arrangement is effective to prevent the deterioration of the deaeration degree of the ink and the evaporation of the aqueous component of the ink The second object indicated above may be achieved according to a third aspect of the invention, which provides a method of producing an ink package comprising an ink accommodating bag in which ink is accommodated, an outer bag which encloses the ink accommodating bag such that a space is defined by and between the ink accommodating bag and the outer bag, and an ink delivering member which includes an ink outlet passage through which the ink in the ink accommodating bag is delivered to an exterior of the ink package, the method comprising the steps of an evacuating step of evacuating an interior of the outer bag to a reduced pressure with one of opposite ends of the outer bag remote from the ink delivering member being kept in an open state while the ink outlet passage is sealed so as to be isolated from the exterior of the ink package; and a welding step of welding the said one of the opposite ends of the outer bag so that the space defined by and between the ink accommodating bag and the outer bag is kept exposed to the reduced pressure.

In one preferred form of the third aspect described above, the ink delivering member further includes a communication passage through which the space is held in communication with the exterior of the ink package, the evacuating step being conducted with the communication passage being sealed so as to be isolated from the exterior of the ink package.

The third object indicated above may be achieved according to a fourth aspect of the invention, which provides an ink-jet recording apparatus comprising: an ink package which includes (a) an ink accommodating bag in which ink is accommodated and which is formed of a first flexible sheet, (b) an outer bag which is formed of a second flexible sheet and which encloses the ink accommodating bag such that a space is defined by and between the ink accommodating bag and the outer bag, and (c) an ink delivering member including a fixing portion to which the outer bag is fixed at an opening thereof and an extending portion which is formed adjacent to the fixing portion so as to extend toward an inside of the outer bag and to which the ink accommodating bag is fixed at an opening thereof, the ink delivering member further including an ink outlet passage through which the ink in the ink accommodating bag is delivered to an exterior of the ink package and a communication passage through which the space is held in communication with the exterior of the ink package; and a main portion which includes (a) an ink-jet printing head, (b) an ink supply passage for supplying the ink delivered from the ink package to the ink-jet printing head, (c) a positive pressure generating source for generating positively pressurized air, and (d) a positively pressurized air delivering passage through which the positively pressurized air generated by the positive pressure generating source is delivered, and wherein the ink package is constructed to be removably mounted on the main portion such that the ink outlet passage of the ink package is connected to the ink supply passage of the main portion while the communication passage of the ink package is connected to the positively pressurized air delivering passage.

When the ink package as described above is mounted on the main portion of the ink-jet recording apparatus constructed as described above, the ink is delivered from the ink package to the ink-jet printing head via the ink supply passage while the positively pressurized air is easily supplied to the space formed by and between the ink accommodating bag and the outer bag. When the ink is initially introduced into the printing head or when the bubbles in the ink are removed from the printing head, the ink can be supplied to the printing head under positive pressure. The space to which the pressurized air is supplied so as to pressurize the ink in the ink accommodating bag is formed by fluid-tightly sealing the outer bag. According to this arrangement, the sealing tightness of the space can be provided by a more simplified and inexpensive structure than in the conventional arrangement in which the rigid cartridge casing is fluid-tightly sealed to provide the space to which the positively pressurized air is supplied. The ink package included in the present ink-jet recording apparatus may have any features defined in claims 2 to 21 described below.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIGS. 2A and 2B are views showing the ink package of FIG. 1, wherein FIG. 2A is a front elevational view and FIG. 2B is a side elevational view;

FIGS. 7A and 7B are views showing the ink cartridge upon shipment, wherein FIG. 7A is a cross sectional view taken along line 2-2 of FIG. 2B and FIG. 7B is an enlarged elevational view of the spout in cross section taken along line 7-7 of FIG. 7A;

FIGS. 8A and 8B are views showing the ink cartridge in a state in which the ink cartridge is mounted on an ink-jet recording apparatus, wherein FIG. 8A is a cross sectional view taken along line 2-2 of FIG. 2B and FIG. 8B is an enlarged elevational view of the spout in cross section taken along line 8-8 of FIG. 8A;

DETAILED DESCRIPTION OF THE PREFERRED EMBODIMENTS

Figure 1:
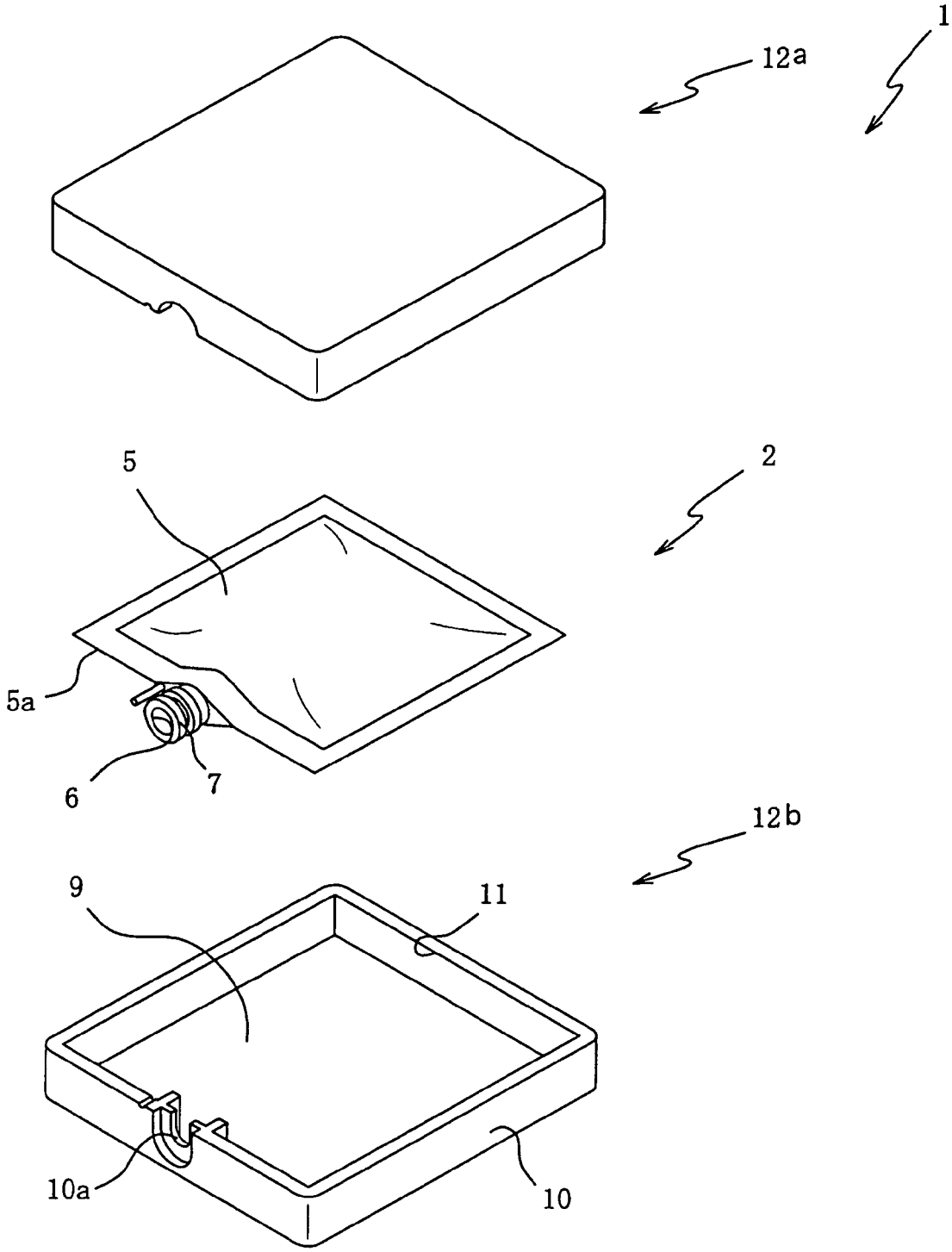
FIG. 1 is an exploded perspective view of an ink cartridge including an in package and a casing constructed according to one embodiment of the present invention.

Referring to the drawings, there will be described preferred embodiments of the present invention.

Referring first to FIG. 1 of the exploded perspective view, there is shown an ink cartridge 1 which includes an ink package 2 constructed according to one embodiment of the present invention.

Figure 6:
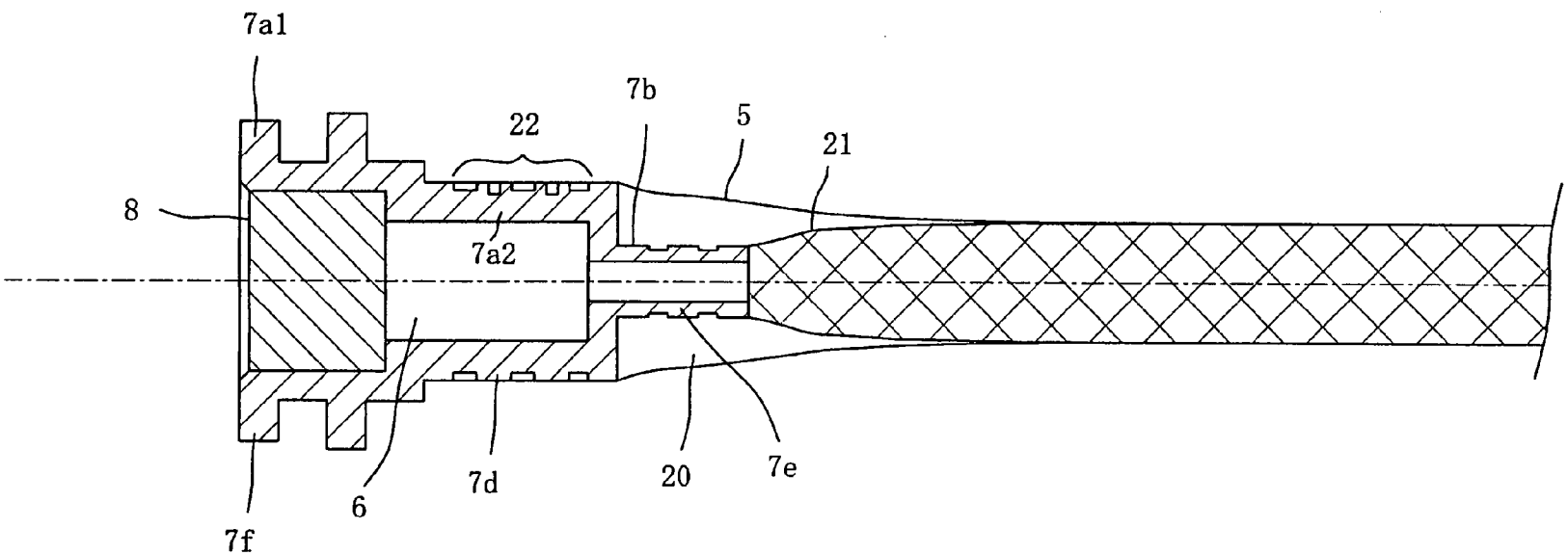
FIG. 6 is an enlarged elevational view of the spout in cross section taken along line 2-2 of FIG. 2B.

The ink cartridge 1 is an ink container which is installed on an ink-jet printer, for instance, and which stores ink to be supplied to a printing head 3 (FIG. 6A) of the ink-jet printer. As shown in FIG. 1, the ink cartridge 1 includes the ink package 2 which is filled with the ink and a casing 12 which is a generally flat, rectangular parallelopiped.

The casing 12 which accommodates the ink package 2 consists of an upper member 12*a* and a lower member 12*b*, which have substantially the same construction. Each of the upper and lower members 12*a*, 12*b* has a bottom wall 9, and four side walls 10 extending from respective four side edges of the bottom wall 9. The upper and lower members 12*a*, 12*b* are butted together at the end faces of the four side walls 10, so as to define an interior space 11 in which the ink package 12 is accommodated such that the opposite major surfaces of the ink package 2 in a generally flattened shape are opposed to the opposed bottom walls 9.

The bottom wall 9 of each of the upper and lower members 12*a*, 12*b* of the casing 12 has an inner surface which is substantially equal in size with the opposite major surfaces of the ink package 2. One of the four side walls 10 of each of the upper and lower members 12*a*, 12*b* has a cutout 10*a*, so that cutouts 10*a* of the two members 12*a*, 12*b* cooperate to define a substantially circular aperture in which an ink delivering member in the form of a spout 7 is fixedly fitted. The structure of the spout 7 will be described in greater detail. With the spout 7 being fitted in the aperture, the ink package 2 is fixedly accommodated in the casing 12. In this state, a plug (FIG. 2A and FIG. 6) which is press-fitted within an ink outlet passage 6 of the spout 7 is accessible through the aperture formed through the corresponding side walls 10 of the upper and lower members 12*a*, 12*b* of the casing 12.

Figure 2B:
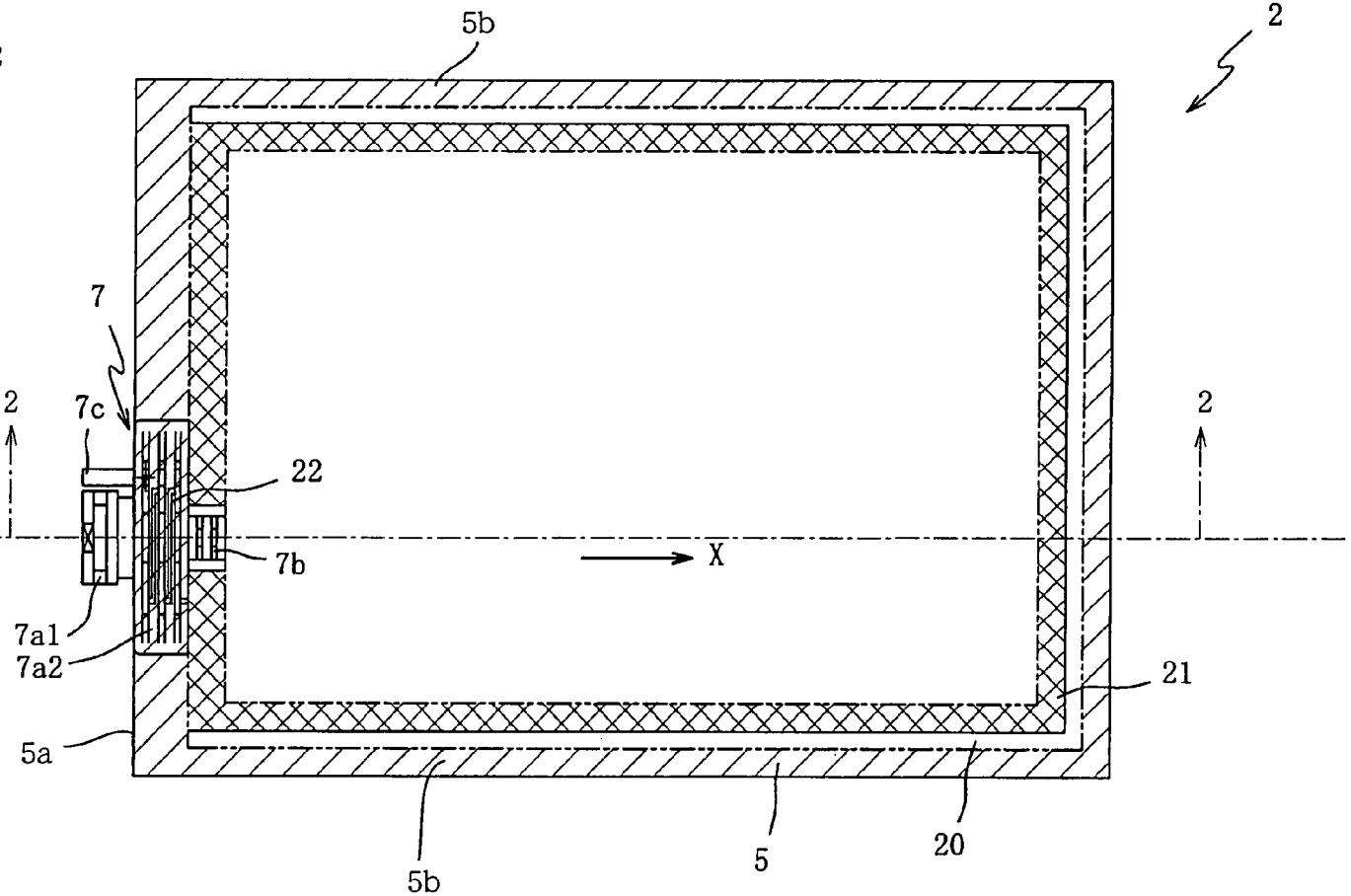

As shown in FIG. 2B, the ink package 2 includes an ink accommodating bag in the form of an inner bag 21, an outer bag 5 which encloses the inner bag 21, and the spout 7 attached to an opening 5*a* of the outer bag 5 and an opening of the inner bag 21. Each of the outer and inner bags 5, 21 is formed from two flexible sheets each in the form of a laminar structure consisting of a plurality of films superposed on each other. The two sheets are superposed on each other and welded together along their peripheries, except a non-welded portion of the periphery of each sheet, such that the two sheets are formed into the inner bag 21 or the outer bag 5 having the opening corresponding to the above-indicated non-welded portion. In the thus constructed ink package 2, there is formed a space 20 defined by and between the outer bag 5 and the inner bag 21, as shown in FIG. 2B.

Each of the two sheets used for the inner bag 21 and the outer bag 5 has the laminar structure which consists of an intermediate layer of an aluminum alloy; a first adhesive layer formed on one of opposite surfaces of the aluminum alloy intermediate layer; an outer layer of nylon formed on the first adhesive layer; a second adhesive layer formed on the other surface of the aluminum alloy intermediate layer; a layer of polyethylene terephthalate (PET) formed on the second adhesive layer; a third adhesive layer formed on the PET layer; and an inner layer of polypropylene formed on the third adhesive layer. The outer and inner bags 5, 21 formed from the laminar sheets described above have a high degree of durability. In particular, the inner layer of polypropylene enables the inner bag 21 to exhibit a high degree of resistance to the ink contained in the inner bag 21. The aluminum alloy intermediate layer prevents the aqueous component of the ink accommodated in the inner bag 21 from evaporating and prevents gases from permeating through and entering the inner bag 21. Further, the aluminum alloy intermediate layer prevents vapors which permeates through the inner bag 21 from going out of the space 20 through the outer bag 5 and prevents gases from permeating through and entering the outer bag 5. Accordingly, this arrangement is effective to prevent the evaporation of the aqueous component of the ink and deterioration of the deaeration degree of the ink.

Figure 2A:
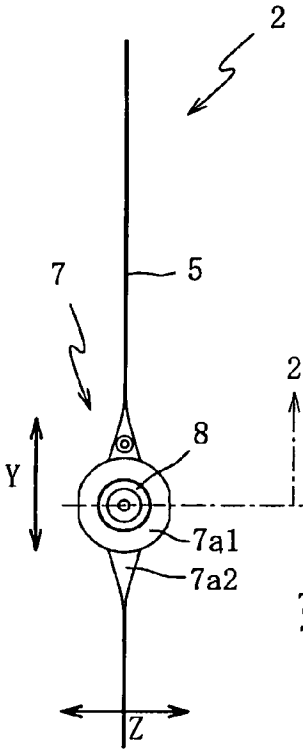

Referring next to FIGS. 2A, 2B, FIG. 3, FIG. 4, FIG. 5, and FIG. 6, there will be explained the structure of the spout 7 in detail. FIG. 2A is a front elevational view of the ink package 2, as seen in a direction in which the spout 7 is inserted into the outer and inner bags 5, 21. FIG. 2B is a side elevational view of the ink package 2 shown in FIG. 2A. The ink package 2 shown in FIGS. 2A and 2B is in a state in which the ink accommodated in the inner bag 21 has been substantially consumed, in other words, in a final contracted state of the ink package 2. The dimension of the spout 7 as measured in a "Z"-direction shown in FIG. 2A (in which the two sheets of the outer bag 5 are opposed to each other) is hereinafter referred to a thickness of the spout 7 while the dimension of the spout 7 as measured in a "Y"-direction shown in FIG. 2A is hereinafter referred to a width of the spout 7.

Described in detail, the spout 7 is formed of a material whose major component is polypropylene having a high degree of resistance to the ink. The spout 7 includes a fixing portion 7*a*2 which is fixed to the outer bag 5, a cylindrical portion 7*a*1 which is formed adjacent to the fixing portion 7*a*2 so as to extend therefrom in a direction opposite to an "X"-direction (FIG. 2B), that is, extend in a direction away from the outer bag 5 and parallel to the axial direction of the fixing portion 7*a*2, an extending portion 7*b* which is fixed to the inner bag 21 and which is formed adjacent to the fixing portion 7*a*2 so as to extend therefrom in the "X"-direction, that is, extend in a direction toward an inside of the outer bag 5 and parallel to the axial direction of the fixing portion 7*a*2, and a hollow protruding portion 7*c* which extends from the fixing portion 7*a*2 in the direction of extension of the cylindrical portion 7*a*1 from the fixing portion 7*a*2 such that the hollow protruding portion 7*c* and the cylindrical portion 7*a*1 are arranged in parallel with each other. The hollow protruding portion 7*c* has an inner passage 22*a* which is formed therethrough and open at one of opposite ends thereof on the side remote from the fixing portion 7*a*2 to the exterior of the ink package 2.

As shown in FIG. 2A, the thickness of the fixing portion 7*a*2 of the spout 7 as measured in the "Z"-direction gradually decreases toward widthwise opposite ends 5*b*, 5*b* of the outer bag 5, in other words, toward opposite two directions "Y" (as indicated by two arrows in FIG. 2A). The fixing portion 7*a*2 includes a plurality of elongate ribs 7*d* formed on its outer circumferential surface to which the inner surface of the opening 5*a* of the outer bag 5 is attached, and a plurality of elongate grooves 22*b* each of which is located between adjacent two elongate ribs 7*d*. The plurality of elongate ribs 7*d* extend in the widthwise opposite directions of the outer bag 5, that is, extend toward the widthwise opposite ends 5*b*, 5*b* of the outer bag 5. The fixing portion 7*a*2 of the spout 7 is thermally welded and fixed at the plurality of elongate ribs 7*d* to the inner surface of the opening 5*a* of the outer bag 5.

Figure 3:
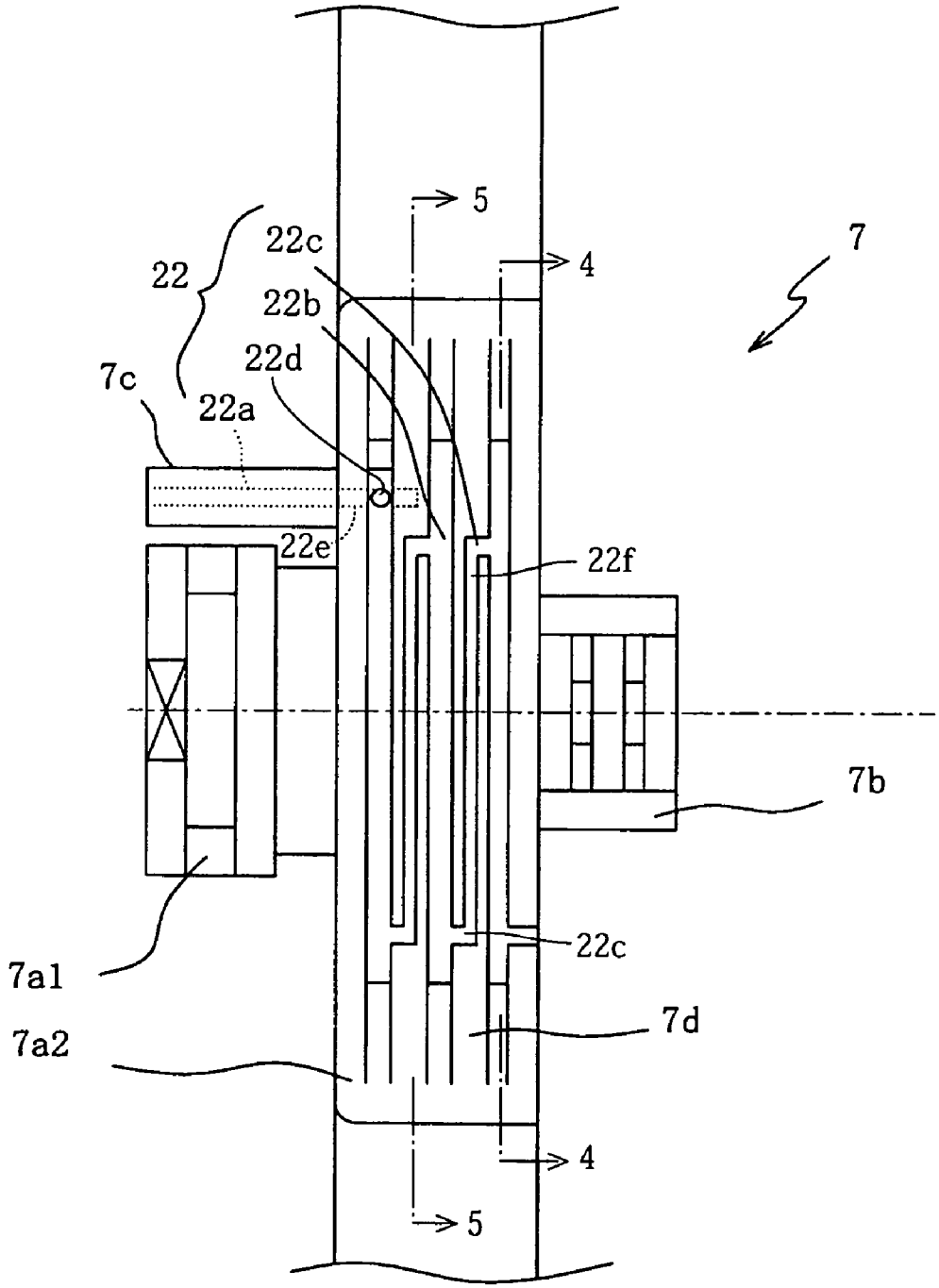
FIG. 3 is an enlarged view of a spout shown in FIG. 2B.
Figure 4:
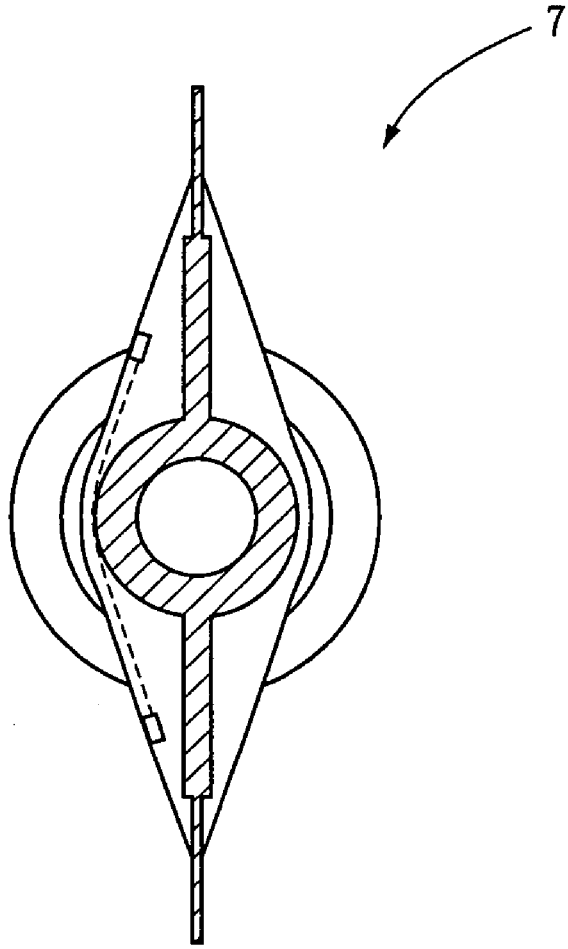
FIG. 4 is a cross sectional view of the spout taken along line 4-4 of FIG. 3.
Figure 5:
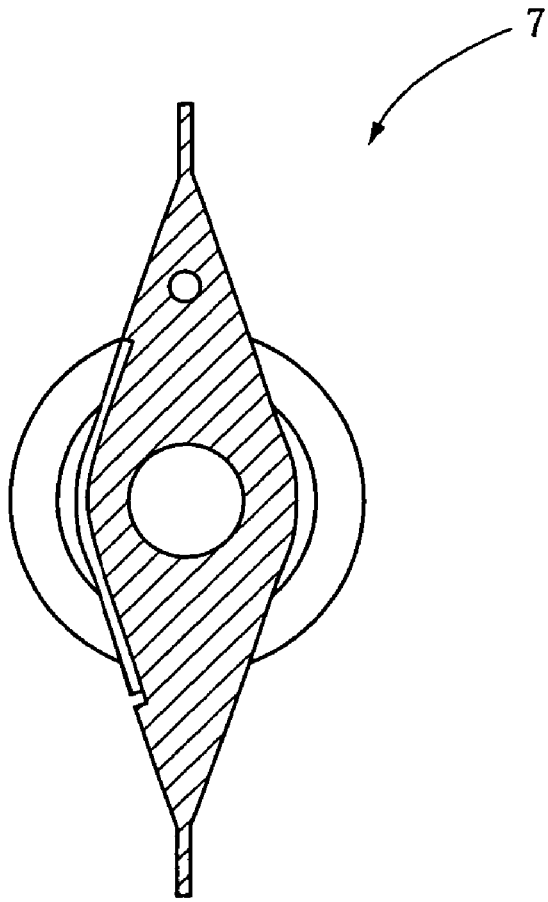
FIG. 5 is a cross sectional view of the spout taken along line 5-5 of FIG. 3.

In the present embodiment, as shown in FIGS. 3-5, an elongate cutout 22*f* and two grooves 22*c*, 22*c* are formed in each of the plurality of ribs 7*d* which are located on one side of a plane of the fixing portion 7*a*2, which plane includes the connected surface at which the two sheets of the outer bag 5 are welded together. Further, in the present embodiment, the elongate cutout 22*f* and the two grooves 22*c*, 22*c* are not formed in the axially outermost rib which is located at one of opposite axial ends of the fixing portion 7*a*2 on the side remote from the outer bag 5 while only one groove 22*c* is formed in the axially innermost rib which is located at the other axial end of the fixing portion 7*a*2 on the side of the outer bag 5. The elongate cutout 22*f* extends in a longitudinal direction of the elongate rib 7*d* while the two grooves 22*c*, 22*c* extend from longitudinal opposite ends of the elongate cutout 22*f* to one and the other of opposite side surfaces of the elongate rib 7*d*, respectively, in a direction perpendicular to the longitudinal direction of the rib 7*d*. The cutout 22*f* and the groves 22*c* formed in each elongate rib 7*d* and the plurality of grooves 22*b* cooperate to define a communication passage 22 in the form of a labyrinth, as shown in FIG. 3, in a state in which the outer bag 5 is fixed to the fixing portion 7*a*2. One of opposite ends of the communication passage 22 is open to the inside of the outer bag 5, namely, the space 20 defined by and between the outer and inner bags 5, 21 via the groove 22*c* formed in the axially innermost rib while the other of the opposite ends of the communication passage 22 is held in communication with the inner passage 22 of the hollow protruding portion 7*c* described above. Described more specifically, the above-indicated other end of the communication passage 22 is held in communication with one of opposite ends of the inner passage 22*a* of the hollow protruding portion 7*c* which is located on the side nearer to the fixing portion 7*a*2, by a connecting passage formed in the fixing portion 7*a*2. The connecting passage consists of a first portion 22*e* which extends in the axial direction of the fixing portion 7*a*2 and a second portion 22*d* which extends from the first portion 22*e* in a direction intersecting the axial direction, namely, in the thickness direction of the fixing portion 7*a*2 (the above-indicated "Z"-direction). In the present embodiment, the axially outermost rib of the fixing portion 7*a*2 functions as a seal portion which continuously extends throughout the periphery thereof so as to inhibit communication between the space 20 and the exterior of the ink package 22 except through the communication passage 22.

Like the fixing portion 7*a*2, the extending portion 7*b* has a thickness (as measured in the "Z"-direction) which gradually decreases toward the widthwise opposite ends 5*c*, 5*c* of the outer bag 5, i.e., toward the opposite two directions "Y" indicated by the two arrows in FIG. 2A. On an outer circumferential surface of the extending portion 7*b* which contacts the inner surface of the inner bag 21, there are formed a plurality of ribs 7*e* (FIG. 6) at which the extending portion 7*b* is thermally welded and fixed to the inner surface of the inner bag 21. The extending portion 7*b* has a cross sectional area smaller than a cross sectional area of the fixing portion 7*a*2, where the cross sectional areas of the extending portion 7*b* and the fixing portion 7*a*2 are taken along respective planes perpendicular to the axial direction of the fixing portion 7*a*2. This arrangement forms, in the vicinity of the extending portion 7*b*, the space 20 even where the substantial portions of the outer bag 5 and the inner bag 21 are held in close contact with each other.

The cylindrical portion 7*a*1 has a flange 7*f* which is formed on its outer circumferential surface at one of axially opposite end portions thereof remote from the fixing portion 7*a*2. The flange 7*f* is fitted in the aperture defined by the two cutouts 10*a* of the lower and upper members 12*a*, 12*b* of the casing 12. The spout 7 includes the ink outlet passage 6 formed through the cylindrical portion 7*a*1, fixing portion 7*a*2, and extending portion 7*b*. The plug 8 press-fitted in the ink outlet passage 6 is formed of a butyl rubber or similar material having a high degree of elasticity or resiliency that assures a sufficient degree of fluid tightness of the inner bag 21 even after an ink-extracting needle 50 (FIGS. 8A and 8B) that has pierced the plug 8 is removed from the plug 8.

With the ink package 2 being accommodated in the casing 12, one of opposite ends of the cylindrical portion 7*a*1 and one of opposite ends of the hollow protruding portion 7*c*, which ends of the portions 7*a*1, 7*c* are on the side remote from the fixing portion 7*a*2, are located on a same plane, so that the openings of the ink outlet passage 6 and the inner passage 22*a* are located on that plane and accessible through the aperture formed through the corresponding side walls 10 of the upper and lower members 12*a*, 12*b* of the casing 12.

Figure 7A:
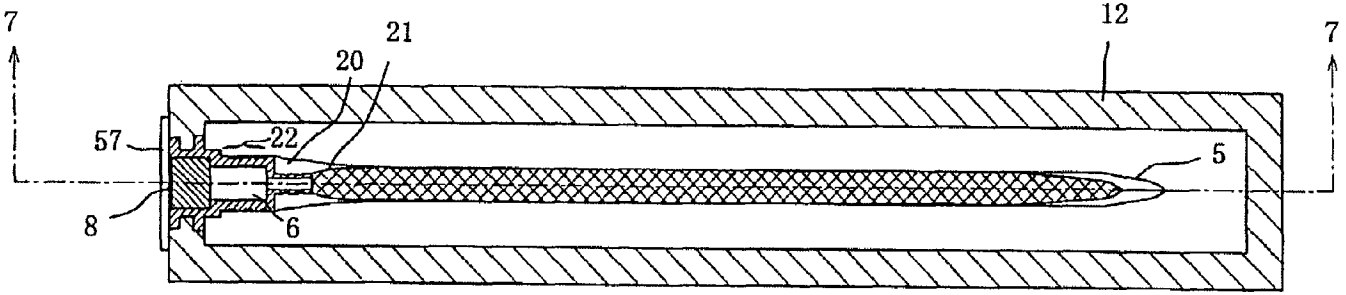
Figure 7B:
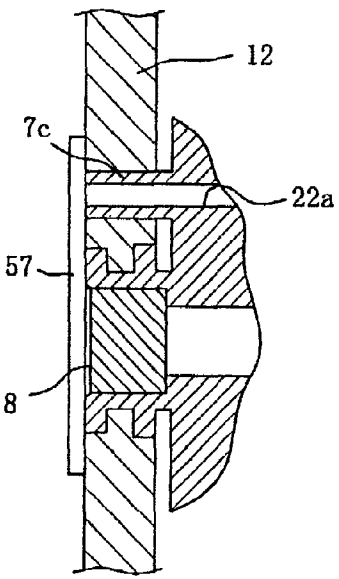

FIGS. 7A and 7B show the ink cartridge 1 in a state upon shipment thereof, in other words, before use of the ink cartridge 1 prior to mounting thereof on an ink-jet recording apparatus. In this state, the space 20 defined by and between the outer and inner bags 5, 21 is in a state in which the space 20 is evacuated to a reduced pressure, and a sealing member 57 is removably fixed or welded to the above-indicated one of the opposite ends of the cylindrical portion 7*a*1 and one of the opposite ends of the hollow protruding portion 7*c*, which ends of the two portions 7*a*1, 7*c* are on the side remote from the fixing portion 7*a*2, for thereby closing the openings of the ink outlet passage 6 and the communication passage 22. The sealing member 57 is formed of a material that inhibits permeation of gases therethrough so as to prevent the ink outlet passage 6 and the communication passage 22 from communicating with the atmosphere. Where the space 20 is in the state in which the space 20 is kept exposed to the reduced pressure, the outer bag 5 is held in close contact with the inner bag 21, so that the ink accommodated in the inner bag 21 receives pressure acting thereon from the outer bag 5. In view of this, the sealing member 57 needs to have a strength enough to withstand the pressure. The sealing member 57 is fixedly attached to the spout 7 so as to close the openings of the ink outlet passage 6 and the communication passage 22.

There will be next described a manner in which the inner bag 21 is enclosed while the space 20 to be formed between the outer and inner bags 5, 21 is evacuated to the reduced pressure. Initially, the sealing member 57 is removably fixed or welded to the spout 7 in the atmosphere so as to cover the above-indicated respective ends of the hollow protruding portion 7*c* and the cylindrical portion 7*a*1. The ink package 2 is placed in a vacuum chamber with one of the lengthwise opposite ends of the outer bag 5 remote from the spout 7 being kept in an open state without being welded. Then, the pressure in the vacuum chamber is adjusted to the reduced pressure, and the above-indicated one of the lengthwise opposite ends of the outer bag 5 is closed by welding with the interior space of the outer bag 5 being kept exposed to the reduced pressure. Thus, the space 20 formed by and between the outer and inner bags 5, 21 is kept exposed to the reduced pressure.

The space 20 may be evacuated otherwise. The ink package 2 in which the outer bag 5 encloses the inner bag 21 therein is placed in the vacuum chamber. The pressure in the vacuum chamber is adjusted to the reduced pressure, and the sealing member 57 is removaby fixed or welded to the spout 7 after the space 20 has been evacuated through the communication passage 22 in the labyrinth form.

In the thus formed ink package 2, the ink is enclosed with two bags, i.e., inner bag 21 and the outer bag 5 which encloses the inner bag 21, and the space 20 formed by and between the two bags 5, 21 is kept exposed to the reduced pressure. This arrangement is effective to prevent permeation of the gases through the two bags, thereby preventing deterioration of the deaertion degree of the ink, and to inhibit evaporation of the aqueous component of the ink, even if the ink package 2 is stored for a relatively long time period. In the present arrangement wherein a space between the casing 12 and the ink package 2 is not evacuated to the reduced pressure, the casing 12 may have a simple structure that has a strength to withstand a shock or impact acting thereon during transportation of the ink cartridge 1.

Figure 8A:
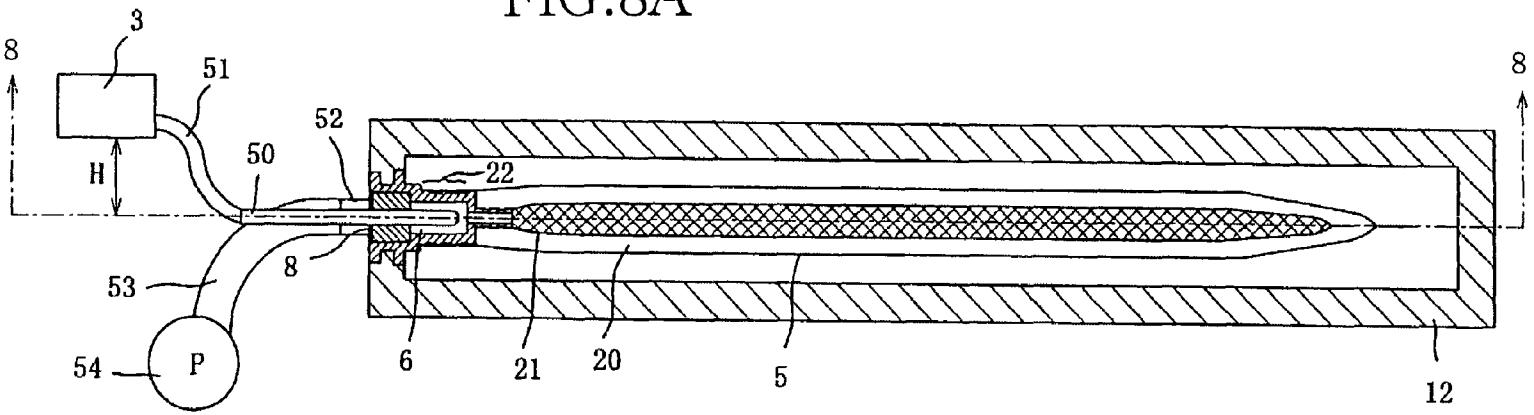
Figure 8B:
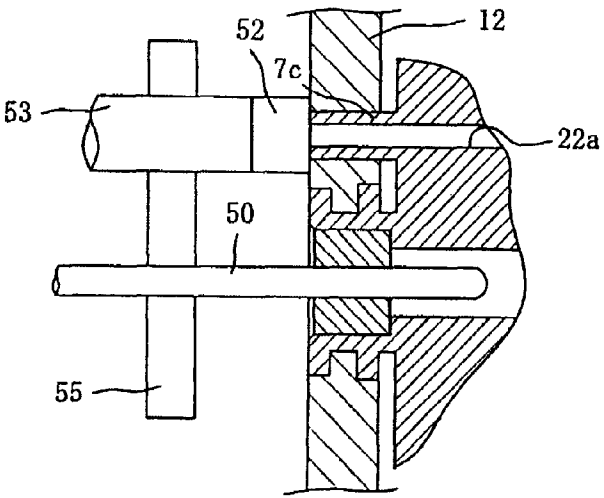

FIGS. 8A and 8B shows the ink cartridge 1 in a state in which the ink cartridge 1 is mounted on a main body of the ink-jet recording apparatus. As known in the art, the main body of the ink-jet recording apparatus includes a mounting portion on which the ink cartridge 1 is removably mounted. As shown in FIGS. 8A and 8B, on one of opposite walls 55 of the mounting portion, there are provided the hollow ink-extracting needle 50 so as to protrude therefrom and a connecting portion 52 which is open to an exterior of the apparatus and through which positively pressurized air is supplied to the space 20 in the ink package 2. The hollow ink-extracting needle 50 is connected to the ink-jet printing head 3 via an ink supply tube (ink supply passage) 51. The ink ejection nozzles of the ink-jet printing head 3 are located on a position which is higher than a position of the hollow ink-extracting needle 50, by a distance (height) H as seen in the gravity direction, so that the ink in the nozzles is given a negative back pressure, as well known in the art. The connecting portion 52 is connected to an air supply pump 54 (positive pressure generating source) via a tube 53 for delivering the positively pressurized air to the space 20 formed by and between the outer and inner bags 5, 21.

The ink cartridge 1 is mounted on the mounting portion of the ink-jet recording apparatus after the sealing member 57 has been removed from the spout 7. When the ink cartridge 1 is mounted on the mounting portion, the hollow ink-extracting needle 50 pierces through the plug 8 and the needle 50 is brought into contact with the ink through the ink outlet passage 6 of the spout 7. In this state, the connecting portion 52 of the mounting portion of the ink-jet recording apparatus is brought into close contact with the leading end of the hollow protruding portion 7*c* of the spout 7, so that the air supply pump 54 is brought into communication with the communication passage 22 via the tube 53.

When the ink is initially introduced into the ink-jet printing head 3 or when the bubbles and poor-quality ink whose viscosity has increased are removed from the printing head 3, the pump 54 is driven to generate positively pressurized air and the generated positively pressurized air is supplied to the space 20 between the outer and inner bags 5, 21 through the tube 53 and the communication passage 22, so that the pressure is applied to the ink in the inner bag 21 and the pressurized ink is introduced into the printing head 3 via the hollow ink-extracting needle 50 and the ink supply tube 51. In this case, as well known in the art, the ink may be sucked from the nozzles by a suction pump with the nozzles being covered by a suction cap while giving the positive pressure to the ink in the inner bag 21. Where the ink is sucked from the nozzles while applying the positive pressure to the ink in the inner bag 21 as described above, the positive pressure is kept applied to the ink in the ink bag 21 at least until a timing immediately after the suction cap has been removed from the nozzles upon completion of suction of the ink from the nozzles, so that the ink discharged into the suction cap is prevented from being sucked back toward the nozzles due to the negative back pressure.

The operation of the pump 54 is stopped during a printing period in which the ink is ejected from the nozzles of the printing head and during a non-printing period. In these states, the space between the outer and inner bags 5, 21 is held in communication with the atmosphere via a space in the pump 54, the tube 53 and the communication passage 22, so that the space 20 is kept at the atmospheric pressure. The above-indicated distance H between the position of the nozzles of the head 3 and the hollow ink-extracting needle 50 as measured in the gravity direction corresponds to the negative back pressure acting on the ink in the nozzles.

Although the inner bag 21 is formed of the material which substantially inhibits permeation of the gases and the vapors therethrough, it is necessary to consider that a trace amount of oxygen in the air may permeate through the inner bag 21 and is dissolved in the ink and that the aqueous component in the ink may be evaporated and the vapors may permeate through the inner bag 21. In view of the above, the communication passage 22 according to the present embodiment is formed to have the labyrinth structure constructed as described above. The communication passage 22 in the form of the labyrinth preferably has a small cross sectional area and a sufficiently large length for the following reasons: When the ink is initially introduced into the ink-jet printing head 3, the pump 54 is operated to apply the positive pressure to the inner bag 21, so that the outside air existing in the exterior of the ink package 2 enters the space 20 defined by and between the outer and inner bags 5 and is kept therein. When the pump 54 is stopped, the volume of the space 20 decreases while the atmosphere in the space 20 remains without being replaced with the outside air existing in the exterior of the ink package 2, owing to the above-described labyrinth structure of the communication passage 22. When the bubbles and poor-quality ink are removed form the printing head 3, the pump 54 is operated to apply the positive pressure to the inner bag 21, so that the outside air existing in the exterior of the ink package 2 is added to the atmosphere in the space 20. When the pump 54 is stopped, the volume of the space 20 decreases while the atmosphere in the space 20 remains without being replaced with the outside air existing in the exterior of the ink package 2, owing to the communication passage 22 having the above-described labyrinth structure. While the pump 54 is not operated, i.e., while the positive pressure is not applied to the inner bag 21, the diffusion is not likely to occur within the communication passage 22 if the cross sectional area of the communication passage 22 is small. Further, if the length of the communication passage 22 within which the diffusion is not likely to occur is sufficiently large, the diffusion between the air in the exterior of the ink package 2 and the atmosphere in the space 20 of the ink package 2 is not likely to occur. Accordingly, the atmosphere in the space 20 is less likely to be replaced with the outside air existing in the exterior of the ink package 2.

In the communication passage 22 formed as described above, it is preferable that the cross sectional area of each elongate groove 22*b* located between the adjacent two elongate ribs 7*d* has a tapered shape in transverse cross section taken along a plane perpendicular to the longitudinal direction of the groove 22*b*, wherein the dimension of the tapered cross sectional shape as measured in a direction perpendicular to the thickness direction (the above-indicated "Z"-direction) of the spout 7 and parallel to the axial direction of the fixing portion 7*a*2 gradually decreases in a direction toward the bottom of the groove 22*b*, for the purpose of permitting the communication passage 22 to have a sufficiently large cross sectional area and volume even if the ribs 7*d* are collapsed or deformed to some extent when the outer bag 5 is welded to the spout 7.

As described above, the space 20 defined by and between the outer and inner bags 5, 21 is kept at the atmospheric pressure owing to the communication passage 22 having the labyrinth structure constructed as described above. Further, the communication passage 22 has a function of supplying the positively pressurized air generated by the pump 54 to the space 20 and a function of inhibiting the dissolution of the gases such as oxygen into the ink and the evaporation of the aqueous component from the ink.

Since the ink is enclosed with the two bags, i.e., the inner bag 21 and the outer bag 5, the evaporation of the aqueous component of the ink is prevented to some extent, and the atmospheric air is substantially inhibited from permeating through the two bags, so that the deterioration of the deaeration degree of the ink is prevented to some extent, even if the space 20 between the outer and inner bags 5, 2 is not kept exposed to the reduced pressure upon shipment of the ink cartridge 1. In this case, while it is preferable to close the opening of the communication passage 22 by the sealing material 57, the deterioration of the deaeration degree of the ink and the evaporation of the aqueous component of the ink are prevented to some extent as described above even where the opening of the communication passage 22 is not closed by the sealing member 57.

While the preferred embodiment of the present invention has been described above, for illustrative purpose only, it is to be understood that the invention is not limited to the details of the illustrated embodiment, but may be embodied with various changes, modifications and improvements, which may occur to those skilled in the art, without departing from the spirit and scope of the invention defined in the attached claims.

In the illustrated embodiment, the communication passage 22 is formed in the state in which the outer bag 5 is fixed to the fixing portion 7*a*2 of the spout 7. The communication passage 22 may be formed such that other suitable member may be fixed to the fixing portion 7*a*2 to cover the elongate grooves 22*b* located adjacent two elongate ribs 7*d*, and the cutout 22*f* and the grooves 22*c* formed in each elongate rib 7*d*. In this case, the outer bag 5 is fixed onto the other member.

In the illustrated embodiment, one of the opposite ends of the communication passage 22 is open to the inside of the outer bag 5 via the groove 22*c* formed in the axially innermost rib of the fixing portion 7*a*2 of the spout 7. The above-indicated one end of the communication passage 22 may be open to the inside of the outer bag 5 via a through-hole formed through the thickness of the axially innermost rib. Further, the innermost rib. may be formed with the elongate cutout 22*f* and the two grooves 22*c* as described above.

In the illustrated embodiment, the thickness of the fixing portion 7*a*2 of the spout 7 as measured in the "Z"-direction gradually decreases toward widthwise opposite ends 5*b*, 5*b* of the outer bag 5, in other words, toward opposite two directions "Y" (as indicated by two arrows in FIG. 2A). The fixing portion 7a2 may be formed otherwise. For instance, the fixing portion 7a2 may have a circular shape in cross section taken along a plane perpendicular to the axial direction thereof.

Figure 9A:
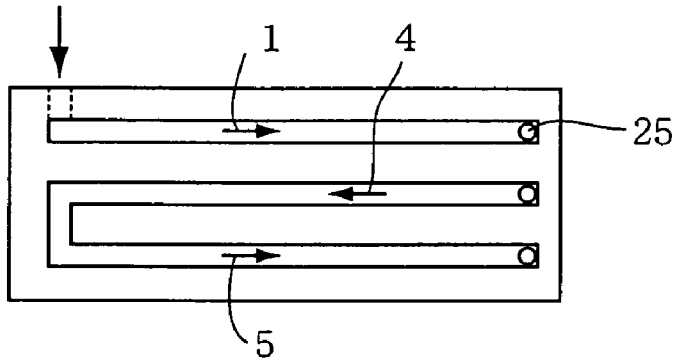
FIGS. 9A and 9B are views respectively showing one and the other of opposite surfaces of a fixing portion of a spout constructed according to another embodiment, the one and the other of the opposite surfaces being respectively located one and the other of opposite sides of a plane of the fixing portion, the plane including a connected surface at which the two sheets of the outer bag are connected to each other.
Figure 9B:
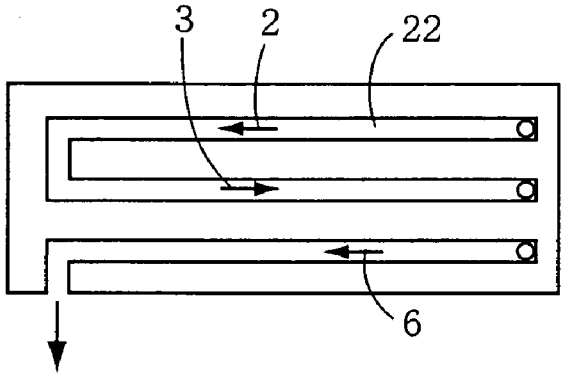
Figure 10:
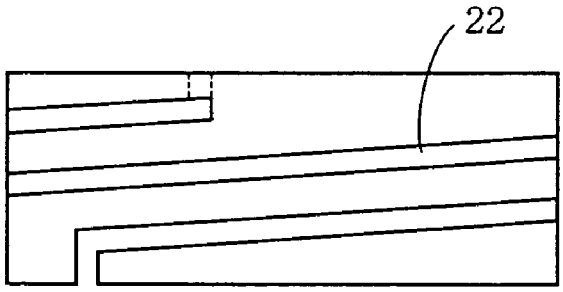
FIG. 10 is a developed view of a fixing portion of a spout constructed according to still another embodiment of the invention.

In the illustrated embodiment, the communication passage 22 having the labyrinth structure is formed on one of opposite sides of the plane of the fixing portion 7a2, the plane including the connected surface at which the two sheets of the outer bag 5 are connected together. The communication passage 22 having the labyrinth structure may be formed on both of the opposite sides of the plane so as to extend in series, as shown in FIGS. 9A and 9B. FIGS. 9A and 9B are views of a fixing portion of a spout constructed according to another embodiment. Described in detail, FIGS. 9A and 9B respectively show one and the other of the opposite outer surfaces of the fixing portion which are respectively located on one and the other of the opposite sides of the above-indicated plane. The communication passage 22 of FIGS. 9A and 9B formed on the opposite outer surfaces of the fixing portion extend in series via the through-holes 25. In the communication passage 22 shown in FIGS. 9A and 9B, the positively pressurized air delivered from the pump 54 is flown in a direction from an arrow numbered with "1" toward an arrow numbered with "6". Further, the communication passage 22 may be formed in a helical form as shown in the developed view of FIG. 10. The communication passage 22 may be formed within the spout 7 or may be formed separately from the spout 7.

What is claimed is:

1. An ink cartridge comprising:

an ink accommodating bag in which ink is accommodated and which is formed of a first flexible sheet;

an outer bag which is formed of a second flexible sheet and which encloses the ink accommodating bag such that a first space is defined by and between the ink accommodating bag and the outer bag;

an ink delivering member including a fixing portion to which the outer bag is fixed at an opening thereof and an extending portion which is formed adjacent to the fixing portion so as to extend toward an inside of the outer bag in a first direction of the fixing portion and to which the ink accommodating bag is fixed at an opening thereof; and a rigid casing which encloses the outer bag and the ink accommodating bag such that a second space is defined by and between the outer bag and the rigid casing and which holds the ink delivering member;

wherein the ink delivering member further includes an ink outlet passage through which the ink in the ink accommodating bag is delivered to an exterior of the ink cartridge and a communication passage through which the first space is held in communication with the exterior of the ink cartridge;

wherein the communication passage is formed at least in a state in which the outer bag is fixed to the fixing portion and includes at least a portion which extends in a direction that intersects the first direction of the fixing portion, the fixing portion having at least one seal portion formed on an outer surface thereof that continuously extends throughout a periphery of the fixing portion; and wherein the ink delivering member has at least one elongate groove which is formed in the outer surface of the fixing portion and which includes at least a portion extending in the direction that intersects the first direction, the elongate groove forming at least a portion of the communication passage in the state in which the outer bag is fixed to the outer surface of the fixing portion.

2. The ink cartridge according to claim 1, wherein the fixing portion has a cross sectional area larger than a cross sectional area of the extending portion, where the cross sectional areas of the fixing portion and the extending portion are taken along respective planes perpendicular to the first direction of the fixing portion.

3. The ink cartridge according to claim 1, wherein the fixing portion has a circular shape in cross section taken along a plane perpendicular to the first direction of the fixing portion.

4. The ink cartridge according to claim 1, wherein the outer bag includes a pair of walls which are opposed to each other in a second direction perpendicular to the first direction of the fixing portion.

5. The ink cartridge according to claim 4, wherein the fixing portion has a first dimension as measured in the first direction, a second dimension as measured in the second direction, and a third dimension as measured in a third direction which is perpendicular to the first direction and the second direction, the third dimension being larger than the first dimension and the second dimension.

6. The ink cartridge according to claim 5, wherein the second dimension of the fixing portion gradually decreases toward opposite ends thereof in the third direction.

7. The ink cartridge according to claim 4, wherein the communication passage is formed on one of opposite sides of a plane of the fixing portion, the plane including a connected surface at which the pair of walls of the outer bag are connected.

8. The ink cartridge according to claim 4, wherein the communication passage is formed on both of opposite sides of a plane of the fixing portion so as to extend in series, the plane including a connected surface at which the pair of walls of the outer bag are connected.

9. The ink cartridge according to claim 1, wherein the first space is in a state, upon shipment of the ink cartridge, in which the first space is evacuated to a reduced pressure, the ink cartridge further comprising a sealing member which is removably provided so as to close the communication passage.

10. The ink cartridge according to claim 1, wherein each of the first and second flexible sheets is provided by a material which substantially inhibits gases or vapors from permeating therethrough.

11. The ink cartridge according to claim 1, wherein the ink delivering member has a rigidity higher than the first and second flexible sheets.

12. The ink cartridge according to claim 1, wherein the ink cartridge is removably mounted on a main portion of an ink-jet recording apparatus which includes an ink-jet printing head, an ink supply passage for supplying the ink delivered from the ink cartridge to the ink-jet printing head, a positive pressure generating source for generating positively pressurized air, and a positively pressurized air delivering passage through which the positively pressurized air generated by the positive pressure generating source is delivered, the ink cartridge being constructed to be removably mounted on the main portion such that the ink outlet passage of the ink cartridge is connected to the ink supply passage of the main portion while the communication passage of the ink cartridge is connected to the positively pressurized air delivering passage.

13. An ink cartridge comprising:

an ink accommodating bag in which ink is accommodated and which is formed of a first flexible sheet:

an outer bag which is formed of a second flexible sheet and which encloses the ink accommodating bag such that a first space is defined by and between the ink accommodating bag and the outer bag:

an ink delivering member including a fixing portion to which the outer bag is fixed at an opening thereof and an extending portion which is formed adjacent to the fixing portion so as to extend toward an inside of the outer bag in a first direction of the fixing portion and to which the ink accommodating bag is fixed at an opening thereof: and a rigid casing which encloses the outer bag and the ink accommodating bag such that a second space is defined by and between the outer bag and the rigid casing and which holds the ink delivering member:

wherein the ink delivering member further includes an ink outlet passage through which the ink in the ink accommodating bag is delivered to an exterior of the ink cartridge and a communication passage through which the first space is held in communication with the exterior of the ink cartridge:

wherein the communication passage is in the form of a labyrinth having at least one bent portion; and wherein the communication passage in the form of the labyrinth includes at least two elongate grooves which extend in a direction that intersects the first direction of the fixing portion substantially at right angles and which are connected at corresponding ones of opposite longitudinal end portions thereof by a connecting groove.

14. The ink cartridge according to claim 13, wherein the communication passage in the form of the labyrinth includes at least three elongate grooves which extend in a direction intersecting the first direction of the fixing portion substantially at right angle, a second one of the at least three grooves being connected, by a first connecting groove, at one of longitudinal opposite end portions thereof to a corresponding longitudinal end portion of a first one of the at least three grooves while the second one of the at least three grooves is connected, by a second connecting groove, at the other of the longitudinal opposite end portions thereof to a corresponding longitudinal end portion of a third one of the at least three grooves.

15. The ink cartridge according to claim 13, wherein the fixing portion includes a plurality of elongate ribs formed on the outer surface thereof and at least one groove each of which is located between adjacent two of the plurality of elongate ribs, at least one of the plurality of elongate ribs being formed with an elongate cutout such that the elongate cutout extends in a longitudinal direction of the at least one of the plurality of elongate ribs, and with two grooves extending from longitudinal opposite ends of the elongate cutout to one and the other of opposite side surfaces of the at least one of the plurality of elongate ribs, respectively.

16. The ink cartridge according to claim 13, wherein the first space which is defined by and between the ink accommodating bag and the outer bag is in a state, upon shipment of the ink cartridge, in which the first space is evacuated to a reduced pressure.

17. The ink cartridge according to claim 16, wherein the ink delivering member has a rigidity higher than the first and second flexible sheets.

18. An ink cartridge comprising:

an ink accommodating bag in which ink is accommodated and which is formed of a first flexible sheet;

an outer bag which is formed of a second flexible sheet and which encloses the ink accommodating bag such that a first space is defined by and between the ink accommodating bag and the outer bag;

an ink delivering member including a fixing portion to which the outer bag is fixed at an opening thereof and an extending portion which is formed adjacent to the fixing portion so as to extend toward an inside of the outer bag in a first direction of the fixing portion and to which the ink accommodating bag is fixed at an opening thereof: and a rigid casing which encloses the outer bag and the ink accommodating bag such that a second space is defined by and between the outer bag and the rigid casing and which holds the ink delivering member;

wherein the ink delivering member further includes an ink outlet passage through which the ink in the ink accommodating bag is delivered to an exterior of the ink cartridge and a communication passage through which the first space is held in communication with the exterior of the ink cartridge;

wherein the ink delivering member further includes a hollow protruding portion which protrudes from the fixing portion so as to extend in a direction away from the outer bag and which has an inner passage formed therethrough, the communication passage which is formed on the fixing portion communicating at one of opposite ends thereof with the first space defined by and between the ink accommodating bag and the outer bag and at the other of the opposite ends with the inner passage of the hollow protruding portion;

wherein the fixing portion has a connecting passage which connects the other of the opposite ends of the communication passage and one of opposite ends of the inner passage of the hollow protruding portion which is located on the side nearer to the fixing portion; and wherein the connecting passage includes a first portion which extends in the first direction of the fixing portion and a second portion which extends from the first portion in a direction intersecting the first direction.

19. The ink cartridge according to claim 18, wherein the ink delivering member further includes a cylindrical portion which is formed adjacent to the fixing portion so as to extend therefrom in the direction away from the outer bag, the ink outlet passage being formed through the cylindrical portion, the fixing portion, and the extending portion, one of opposite openings of the cylindrical portion which is remote from the fixing portion and one of opposite ends of the hollow protruding portion which is remote from the fixing portion being located on a same plane.

20. The ink cartridge according to claim 18, wherein the first space which is defined by and between the ink accommodating bag and the outer bag is in a state, upon shipment of the ink cartridge, in which the first space is evacuated to a reduced pressure.

21. The ink cartridge according to claim 20, wherein the ink delivering member has a rigidity higher than the first and second flexible sheets.

* * * * *